US006088001A

United States Patent [19]

Burger et al.

[11] Patent Number: 6,088,001

[45] Date of Patent: Jul. 11, 2000

[54] DEVICE FOR FASTENING AN EXCITATION ELEMENT IN A METAL WAVEGUIDE OF AN ANTENNA AND FOR ELECTRICALLY CONNECTING THE SAME TO A COAXIAL LINE ARRANGED OUTSIDE THE WAVEGUIDE

[75] Inventors: Stefan Burger, Freiburg; Klaus-Peter Oberle, Weilheim, both of Germany

[73] Assignee: Endress + Hauser GmbH + Co., Maulburg, Germany

[21] Appl. No.: 09/089,689

[22] Filed: Jun. 3, 1998

[30] Foreign Application Priority Data

Jun. 6, 1997 [DE] Germany ..... 197 23 880

[51] Int. Cl.[7] ..... H01Q 13/00

[52] U.S. Cl. ..... 343/772; 343/785; 343/786; 333/21 A

[58] Field of Search ..... 343/771, 772, 343/785, 786, 906; 333/21 A, 21 R, 208, 212, 227, 230

[56] References Cited

U.S. PATENT DOCUMENTS

| | | | |
|---|---|---|---|
| 3,128,467 | 4/1964 | Lanctot | 343/785 |
| 4,011,566 | 3/1977 | Honda | 343/785 |
| 4,197,546 | 4/1980 | Cachier et al. | 343/701 |
| 5,066,958 | 11/1991 | Blachley | 343/756 |
| 5,880,698 | 3/1999 | Burger | 343/772 |

FOREIGN PATENT DOCUMENTS

| | | |
|---|---|---|
| 93 12 251 | 1/1994 | Germany . |
| 94 12 243 | 11/1994 | Germany . |
| 196 29 593 | 1/1998 | Germany . |
| 49-90032 | 8/1974 | Japan . |
| 53-105645 | 8/1978 | Japan . |
| 62-144404 | 6/1987 | Japan . |
| 62-154899 | 7/1987 | Japan . |
| 2-261203 | 1/1991 | Japan . |
| 905417 | 9/1962 | United Kingdom . |

OTHER PUBLICATIONS

European Patent Office, Patent Abstracts of Japan, Japanese Publication 02 261 203 entitled "Microwave Receiver" which has Publication Date of Oct. 24, 1990.

Deshpande, M.D. and Das, B.N., *Analysis of an End Launcher for a Circular Cylindrical Waveguide*, IEEE Transactions on Microwave Theory and Techniques, vol. MIT–26, No. 9, Sep., 1978, pp. 672–675.

Ragan, George L., *Microwave Transmission Circuits*, Massachusetts Institute of Technology Radiation Laboratory Series, 1948, pp. 314–361.

*Primary Examiner*—Tan Ho

*Attorney, Agent, or Firm*—Bose McKinney & Evans LLP

[57] ABSTRACT

A device is provided for fastening an excitation element (2) in a metal waveguide (3) of an antenna (1) and for electrically connecting the same to a coaxial line (4) arranged outside the waveguide (3), and which is cost effective and in which low power losses occur. The device comprises a basic member (6), which seals an opening in the waveguide (3), has a bore (6.1), and a metal hollow cylinder (9), through which an inner conductor of the coaxial line (9) is guided, which hollow cylinder has a first section (9.1) plugged into the first bore (6.1), and which has a second section (9.2), over which an end region (10) of an outer conductor of the coaxial line (4) is pushed. A first end (2.1) of the excitation element (2) is fastened on one end (12) of the inner conductor.

9 Claims, 2 Drawing Sheets

DEVICE FOR FASTENING AN EXCITATION ELEMENT IN A METAL WAVEGUIDE OF AN ANTENNA AND FOR ELECTRICALLY CONNECTING THE SAME TO A COAXIAL LINE ARRANGED OUTSIDE THE WAVEGUIDE

FIELD OF THE INVENTION

The invention relates to a device for fastening an excitation element in a metal waveguide of an antenna and for electrically connecting the same to a coaxial line arranged outside the waveguide.

BACKGROUND OF THE INVENTION

Devices of the abovenamed type can be used, inter alia, in filling level metrology. There, microwaves, are transmitted by means of an antenna to the surface of a filled material, and the echowaves reflected at the surface are received. An echo function representing the echo amplitudes as a function of distance is formed, and is used to determine the probable useful echo and the propagation time of the latter. The spacing between the surface of the filled material and the antenna is determined from the propagation time.

It is possible to use all known methods which permit relatively short distances to be measured by means of reflected microwaves. The best known examples are pulsed radar and frequency-modulated continuous wave radar (FMCW radar).

It is normal to use horn or rod antennas in filling level metrology. Horn antennas have a waveguide on which a funnel-shaped metal horn is integrally formed in the direction facing the filled material. Rod antennas likewise have a waveguide. However, in this type of antenna there is inserted into the waveguide a rod which is made from a dielectric and extends in the direction facing the filled material. Both types of antenna are usually fed via a coaxial line, which is connected to an excitation element projecting into the waveguide. For the purpose of the electrical connection of the excitation element, use is made of relatively expensive, commercially available plugs and sockets, e.g. of type SMA or N. Such connecting elements are not only expensive, but also cause power losses, since there is present at each transition an impedance jump at which a proportion of the microwaves is reflected. This reflected proportion is no longer available for measurement as useful microwave energy.

The excitation element is, for example, a transmitting pin which is inserted laterally into a circular waveguide and through which electric field components are excited. Here, laterally means perpendicular to the longitudinal axis of the waveguide.

Recent developments by the applicant have shown that it is possible to use a transmitting wire as excitation element. Reference is made in this regard to the German patent application filed on Jul. 23, 1996 and having the file number 196 29 593. The transmitting wire described there has a straight section and two limbs adjoining thereto. The transmitting wire is inserted into a circular waveguide in an axial direction. Magnetic field components are excited by the transmitting wire.

SUMMARY OF THE INVENTION

It is an object of the invention to specify a device for fastening an excitation element in a metal waveguide of an antenna and for electrically connecting the same to a coaxial line arranged outside the waveguide, which device is cost effective and in which low power losses occur.

For this purpose, the invention constitutes a device for fastening an excitation element in a metal waveguide of an antenna and for electrically connecting the same to a coaxial line arranged outside the waveguide, which device comprises:

- a metal basic member which seals an opening in the waveguide and has a first through-bore,
- a metal hollow cylinder,
  - through which an inner conductor, surrounded by an insulation, of the coaxial line is guided,
  - which hollow cylinder has a first section plugged into the first bore, and
  - which has a second section,
  - over which an end region of an outer conductor of the coaxial line is pushed, and
- a metal sleeve which is fastened by crimping and which coaxially embraces the second section of the hollow cylinder and the end region of the outer conductor,
- a first end of the excitation element being fastened on an insulation-free end of the inner conductor which extends into the interior of the waveguide.

In accordance with one refinement of the invention, the excitation element is a transmitting wire.

In accordance with one development, the basic member has a second bore, in which a second end of the excitation element is fixed.

In accordance with one development, there is arranged between the basic member and an inner lateral surface of the opening in the wall of the waveguide a seal which is inserted into a groove running around the basic member.

In accordance with one development, one end of the waveguide, in which the basic element is arranged, is short-circuited by the latter.

In accordance with a further refinement, the hollow cylinder is fastened in the basic member by means of a press fit.

In accordance with one refinement, the first end of the excitation element has an axial, central blind bore, is plugged on to the end of the inner conductor, and is fastened there by means of crimping, soldering or welding.

In accordance with one embodiment, the basic member rests with an outer annular surface on a spring ring.

In accordance with one refinement, the excitation element is a transmitting pin.

BRIEF DESCRIPTION OF THE DRAWINGS

The invention and further advantages will now be explained in more detail with the aid of the figures of the drawing, in which an exemplary embodiment is represented; identical elements are provided in the figures with identical reference numerals.

DETAILED DESCRIPTION OF THE PREFERRED EMBODIMENTS

Figure 1:
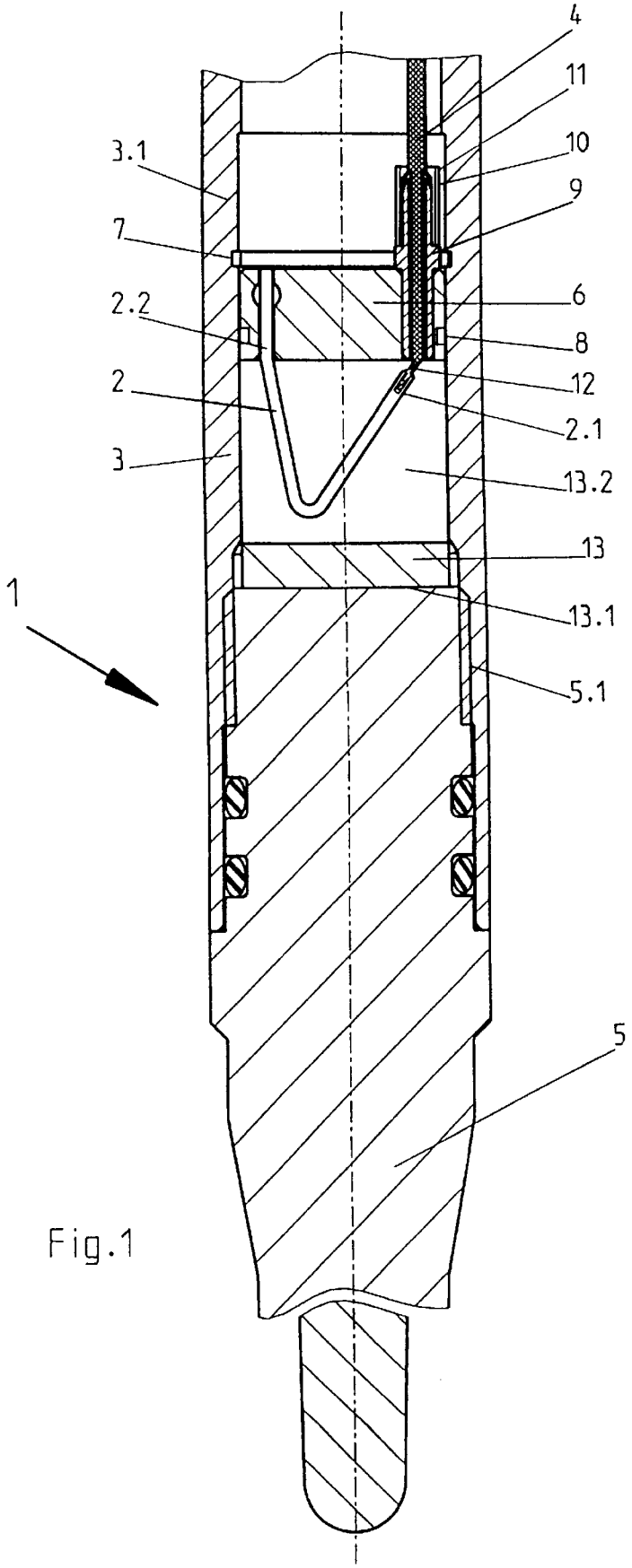
FIG. 1 shows a section through a device according to the invention.

FIG. 1 shows a section through an antenna 1 having a device for fastening an excitation element 2 in a metal waveguide 3 and for electrically connecting the same to a coaxial line 4 arranged outside the waveguide 3.

The microwaves are generated by a microwave generator (not represented in the figure) and guided via the coaxial line 4 to the antenna 1.

The microwave generator is, for example, a pulsed radar unit, an FMCW unit or a continuously oscillating microwave oscillator.

The coaxial line 4 has an inner conductor, surrounded by an insulation, and an outer conductor coaxially surrounding the inner conductor and the insulation.

The waveguide 3 is a section of a cylindrical tube made from a metal, e.g. from aluminum or from a stainless steel. A rod 5 made from a dielectric is screwed into one end of the waveguide 3 by means of a thread 5.1. The microwaves are transmitted via this rod 5 into the free space and received from there.

Figure 4:
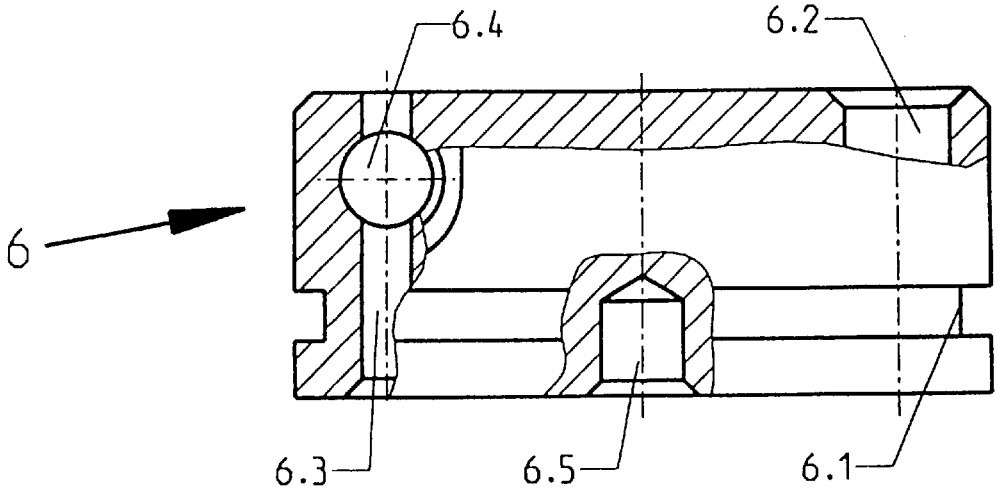
FIG. 4 shows a partially sectioned view of the basic member of FIG. 1.

At the end of the waveguide 3 averted from the rod, there is an opening of circular cross section into which a basic member 6 is inserted. FIG. 4 shows a partially sectioned view of the basic member 6. The latter is cylindrical and consists of a metal, for example of a stainless steel. The diameter of the basic member 6 is dimensioned in such a way that the basic member 6 seals the opening of the waveguide 3. The end of the waveguide 3, in which the basic member 6 is arranged, is thus short-circuited for microwaves by the latter.

Extending in the axial direction on the side averted from the rod is a further section 3.1 of the tube, which forms the waveguide 3. An annularly circumferential groove is arranged on the inside of this section 3.1. Arranged in said groove is a spring ring 7, which extends radially into the interior of the section 3.1. The basic member 6 rests with an outer annular surface on the spring ring 7. The spring ring 7 prevents movement of the basic member 6 in the axial direction averted from the rod.

A seal 8 is arranged between the basic member 6 and an inner lateral surface of the opening of the waveguide 3. Said seal is inserted into a groove 6.1 running annularly around the basic member 6. The seal 8 clamps the basic member 6 in the opening of the waveguide 3 and seals an annular cylindrical gap existing between the waveguide 3 and basic member 6. This is important, for example, whenever a cavity, for example the section 3.1 of the tube, existing on the side of the basic member 6 averted from the rod has to be filled with a casting compound.

In addition to the fastening, which comes about by virtue of the seal 8, a solid cylinder 13 made from a dielectric can be arranged on the side of the basic member 6 facing the rod. Said cylinder rests with a circular base face 13.1 on the rod 5. On its side averted from the rod, the solid cylinder 13 has a gap 13.2 for holding the excitation element 2, and the basic member 6 rests on an end face of the solid cylinder 13 which is opposite the base face 13.1 and interrupted by the gap 13.2. A movement of the basic member 6 in the direction facing the rod is thus prevented by the seal 8 and by the solid cylinder 13.

In the exemplary embodiment represented in FIG. 1, the excitation element 2 is a transmitting wire. The latter has a straight section and two limbs adjoining thereto. The transmitting wire is inserted in the axial direction of the waveguide 3, with the result that the straight section extends essentially parallel to a surface, facing the rod, of the basic member 6, and thus extends perpendicular to the longitudinal axis of the waveguide 3. Magnetic field components are excited by the transmitting wire.

However, a transmitting pin (not represented in the figures) inserted laterally into the waveguide 3 can also be used as excitation element by means of which electric field components are excited. Here, laterally means perpendicular to the longitudinal axis of the waveguide.

The excitation element 2, here a transmitting wire, is located on the side of the basic member 6 facing the rod. The coaxial line 4 leads from the microwave generator to the side of the basic member 6 averted from the rod. Provided for the purpose of electrically connecting the excitation element 2 to the coaxial line 4 is a hollow metal cylinder 9 through which the inner conductor, surrounded by the insulation, of the coaxial line 4 is guided. The basic member 6 has a first axial through-bore 6.2. Plugged into the latter is a first section 9.1 of the hollow metal cylinder 9. The first section 9.1 is fastened in the bore, preferably by means of an interference fit.

A second section 9.2 of the hollow cylinder 9 extends in an axial direction on the side of the basic member 6 averted from the rod. The radially outwardly extending shoulder 9.3, with which the hollow cylinder 9 rests on a surface of the basic member 6 averted from the rod, is integrally formed between the first and the second sections 9.1, 9.2. The result of this is to prevent the hollow cylinder 9 from being plugged too far into the first bore 6.2 of the basic member 6 during assembly.

Except for an end section which is averted from the rod and is very short by comparison with the length of the section 9.2, section 9.2 is cylindrical. The outside diameter of the end section of the second section 9.2 decreases in the direction averted from the rod. As represented in FIG. 1, an end region 10 of the outer conductor of the coaxial line 4 is pushed over the entire second section 9.2 of the hollow cylinder 9.

Figure 2:
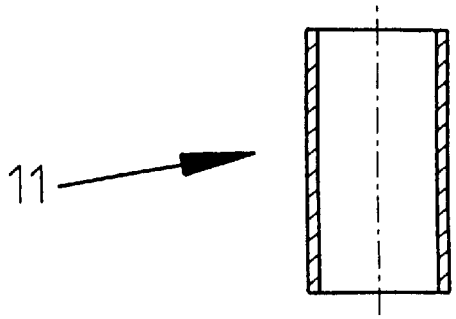
FIG. 2 shows the metal sleeve of FIG. 1, in section.
Figure 3:
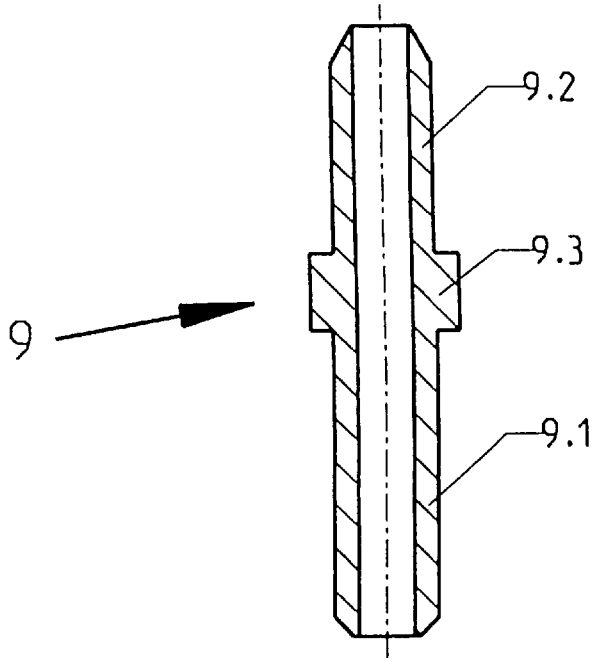
FIG. 3 shows the hollow cylinder of FIG. 1, in section.

A metal sleeve 11, represented in detail in FIG. 2, is provided, which coaxially embraces the second section 9.2 of the hollow cylinder 9 and the end region 10 of the outer conductor. Said sleeve is fastened by crimping.

The inner conductor of the coaxial line 4 is guided through the hollow cylinder 9 and has an insulation-free end 12 projecting into the waveguide 3. A first end 2.1 of the excitation element 2 is fastened to said end.

For this purpose, the first end 2.1 preferably has an axial, central blind bore, which is plugged on to the end 12 of the inner conductor and fastened there by crimping, soldering or welding.

The basic member 6 has a second axial bore 6.3, which extends parallel to the first bore 6.2 and is spaced therefrom. A second end 2.2 of the excitation element 2 is plugged into this second bore 6.3 and fixed there. Provided for this purpose is a further bore 6.4, which extends perpendicular to the second bore 6.3 and leads from a cylindrical lateral surface of the basic member 6 to the second bore 6.3. Mounted in this second bore 6.4 is a fixing screw (not represented in the figures), by means of which the second end 2.2 of the excitation element 2 is fixed in the second bore 6.3. It is also possible to use other types of fastening.

During assembly of the device, the coaxial line 4 is firstly prepared in such a way that it has an insulation-free end 12 and a section adjoining thereto which has an inner conductor and insulation. The metal sleeve 11 is plugged on to the coaxial line 4 thus prepared, and the end of the coaxial line 4 is subsequently guided into the hollow metal cylinder 9 until the insulation-free end 12 projects from the hollow metal cylinder 9. In this case, the section 9.1 of the hollow cylinder 9 is already press-fitted into the bore 6.2 of the basic member 6. Since the outside diameter of the hollow cylinder 9 decreases at the end, the end region 10 of the outer conductor of the coaxial line 4 slips over the section 9.2 of the hollow cylinder 9.

In a next step, the metal sleeve 11 is positioned such that it surrounds the section 9.2 of the hollow cylinder 9 and the end region 10 of the outer conductor in order to be crimped on there.

The excitation element 2 is to be fastened in the way of that described. In a further work operation, the seal 8 is inserted into the groove 6.1, and the basic member 6 is pushed into the opening of the waveguide 3. Provided for this purpose on the side of the basic member 6 facing the rod are guide bores 6.5 into which an appropriately shaped tool for assembling the basic member 6 is plugged. Thereafter, the solid cylinder 13 is inserted if appropriate into the waveguide 3, and the rod 5 is screwed into the thread 5.1.

In the case of a horn antenna, the construction would be performed entirely analogously. The sole important difference from the rod antenna consists in that a funnel-shaped horn is integrally formed on the waveguide 3.

In the exemplary embodiment described, the excitation element 2 is a transmitting wire. A transmitting pin inserted laterally into a circular waveguide and which excites the electric field components can also be used as excitation element. Here, laterally means perpendicular to the longitudinal axis of the waveguide. For the purpose of fastening a transmitting pin, the basic member is to be fitted in an opening arranged on a cylindrical lateral surface of the waveguide, and one end of the transmitting pin, for example a pin-shaped sleeve, is to be fastened to the insulation-free end of the inner conductor in the interior of the waveguide, for example by means of crimping. A second end of the transmitting pin is located in the interior of the waveguide.

What is claimed is:

1. A device for fastening an excitation element (2) in a metal waveguide (3) of an antenna (1) and for electrically connecting the excitation element (2) to a coaxial line (4) arranged outside the waveguide (3), which device comprises:

a metal basic member (6) which seals an opening in the waveguide (3) and has a first through-bore (6.1), a metal hollow cylinder (9), through which an inner conductor, surrounded by an insulation, of the coaxial line (4) is guided, which hollow cylinder has a first section (9.1) plugged into the first bore (6.1), and which has a second section (9.2), over which an end region (10) of an outer conductor of the coaxial line (4) is pushed, and a metal sleeve (11) which is fastened by crimping and which coaxially embraces the second section (9.2) of the hollow cylinder (9) and the end region (10) of the outer conductor, a first end (2.1) of the excitation element (2) being fastened on an insulation-free end (12) of the inner conductor which extends into the interior of the waveguide (3).

2. The device as claimed in claim 1, in which the excitation element (2) is a transmitting wire.

3. The device as claimed in claim 2, in which the basic member (6) has a second bore (6.3), in which a second end (2.2) of the excitation element (2) is fixed.

4. The device as claimed in claim 2, in which one end of the waveguide (3), in which the basic member (6) is arranged, is short-circuited by the latter.

5. The device as claimed in claim 2, in which the first end (2.1) of the excitation element (2) has an axial, central blind bore which is plugged on to the end (12) of the inner conductor and is fastened there by means of crimping, soldering or welding.

6. The device as claimed in claim 1, further comprising a seal (8) arranged between the basic member (6) and an inner lateral surface of the opening in the wall of the waveguide (3), the seal (8) being inserted into a groove running around the basic member (6).

7. The device as claimed in claim 1, in which the hollow cylinder (9) is fastened in the basic member (6) by means of a press fit.

8. The device as claimed in claim 1, in which the basic member (6) rests with an outer annular surface on a spring ring (7).

9. The device as claimed in claim 1, in which the excitation element (2) is a transmitting pin.

* * * * *